US006213389B1

(12) United States Patent
Cai

(10) Patent No.: US 6,213,389 B1
(45) Date of Patent: Apr. 10, 2001

(54) TAKE-OUT CARRIER

(75) Inventor: Liming Cai, West Chester, PA (US)

(73) Assignee: Dopaco, Inc., Exton, PA (US)

( * ) Notice: Subject to any disclaimer, the term of this patent is extended or adjusted under 35 U.S.C. 154(b) by 0 days.

(21) Appl. No.: 09/323,839

(22) Filed: Jun. 2, 1999

(51) Int. Cl.[7] ..... B65D 25/04

(52) U.S. Cl. ..... 229/120.08; 229/917; 229/904; 229/136; 493/331

(58) Field of Search ..... 229/120.08, 904, 229/136, 917; 206/562, 563; 493/311, 331, 334

(56) References Cited

U.S. PATENT DOCUMENTS 2,874,891 * 2/1959 Kelsall ..... 229/136
3,189,247 * 6/1965 Wischusen ..... 229/904 X
3,352,053 * 11/1967 Anderson ..... 229/904 X
3,512,823 * 5/1970 D'esposito et al. ..... 229/136 X
3,722,781 * 3/1973 Page et al. ..... 229/904 X
4,431,128 * 2/1984 Dirico ..... 229/904 X
4,694,987 * 9/1987 Forbes, Jr. ..... 229/114
4,804,137 * 2/1989 Harby ..... 229/906 X
4,910,247 * 3/1990 Haldar et al. ..... 229/87.05
5,205,474 * 4/1993 Stuart et al. ..... 229/904 X
5,655,707 * 8/1997 Jensen ..... 229/160.2
5,890,648 * 4/1999 Cai ..... 229/904 X

* cited by examiner

*Primary Examiner*—Allan N. Shoap
*Assistant Examiner*—Tri M. Mai
(74) *Attorney, Agent, or Firm*—Dennison, Scheiner, Schultz & Wakeman

(57) ABSTRACT

A take-out carrier wherein the compartments thereof are divided by a partition wall secured, only in the fully erected position of the carrier, by complementary cohesive coatings on the partition wall flange and the bottom panel of the carrier, the carrier, prior to alignment of the cohesive coatings, being collapsible for stacking and storage.

11 Claims, 5 Drawing Sheets

70
68
56
60
50
54
62
72
58
52

56
74
5
66
54
50
60
68
58
52
64
62

50
64
66
74
56
62
60
68

TAKE-OUT CARRIER

BACKGROUND OF THE INVENTION

Take-out carriers or meal trays for the accommodation of multiple separate foodstuffs are commonly used in fast food restaurants, cafeterias and the like.

Such carriers are basically of a rectangular configuration with a large open compartment for the main foodstuff such as hamburgers, chicken pieces, and the like, and one or more secondary compartments with top panels having openings defined therein for receiving smaller containers for drinks, french fries and like foodstuffs.

These carriers are conventionally formed of folded paperboard or like sheet material, and unless preassembled at the point of manufacture, must be assembled or erected at the point of sale, either by the server or the customer. Heretofore, this has involved a rather elaborate manipulation or series of manipulations to align specifically provided locking tabs with a series of companion openings or slots, and an engagement of the tabs through the slots. As this is being done, the basic "box" portion of the carrier must be maintained to allow for substantially simultaneous engagement of the tabs. There is also the possibility of the tabs disengaging as the carrier is handled, particularly during use. While the procedures involved in erecting carriers with locking tabs appears quite straightforward, some degree of skill is involved in both properly aligning all of the involved tabs and ensuring that each tab is firmly and correctly inserted through the appropriate slot. If this is done by the serving establishment, it will probably be done innumerable times in a relatively short period of time, again requiring the exercise of a degree of skill by the serving personnel. If the tray is to be erected by the customer, as in a cafeteria environment, a lack of familiarity with the steps of aligning and engaging the tabs with the slots could be a problem.

Multiple compartment meal trays have also been proposed wherein adhesives have been used. However in such cases substantial assembly prior to shipping is involved, and relatively extensive modifications are required in the manufacturing procedures as compared to the basic tab and slot construction.

SUMMARY OF THE INVENTION

The take-out carrier of the present invention, while retaining the basic configuration and appearance of the conventional carrier or carriers with locking tab and slot assembly, substantially improves thereon in several aspects, including simplified manufacturing procedures, and an assembly procedure which is trouble-free and insures a proper erection of the carrier in a fool-proof manner even by unskilled personnel. The erected carrier, that is the carrier in its usable configuration, cannot inadvertently collapse, has no projecting tabs as might be accidently disengaged, and, when erected, provides substantially greater strength and stability.

These particular advantages are achieved with only very minor modifications in the conventional manufacturing equipment, and in fact utilize manufacturing techniques which are in some instances simplified. Manufacture of the carriers of the invention will involve only conventional equipment currently in use, while at the same time producing the superior product of the invention.

The carrier or carriers of the invention, as in the conventional carriers, include at least two compartments formed in a tray by one or more transverse partition walls folded downward from a top panel at an intermediate point along the length of the tray. The partition includes a laterally directed edge flange. In the conventional carton, the edge flange will have outwardly directed end tabs receivable within slots in the opposed side walls of the tray. Such an attachment means is rather difficult to engage, is not particularly secure, and does not provide for a positive seal along the base of the partition wall.

In the construction of the invention, the end tabs are eliminated and the undersurface of the partition wall flange is provided with a cold seal or cohesive coating along the full length thereof. Such a coating remains dry and non-sticking when touching any surface other than a similar cohesive coating. When touching a similar coating, there will be an immediate bonding therebetween which can be enhanced by a little finger pressure on the overlying portions. A similar coating is provided transversely across the upper surface of the bottom panel of the tray at a point corresponding to the desired upright position of the partition wall. Thus, in order to complete the erection of the carton of the invention, one need merely downwardly fold the partition wall until the edge flange thereof, with the cohesive coating thereon, engages the cohesive coating on the bottom panel, at which point a bonding is effected and a proper orientation of the partition wall is automatically achieved. The full length engagement of the coated flange and bottom panel effects a positive seal between the compartments to avoid any leakage therebetween and provides enhanced strength to the overall carton or carrier, and at the same time avoids any possibility of accidental disassembly. These factors are particularly significant in view of the relatively lightweight nature of the carrier and the relatively heavy products to be carried therein.

Other features, objects and advantages of the invention will become apparent from the following more detailed description.

DESCRIPTION OF THE PREFERRED EMBODIMENTS

Figure 1:
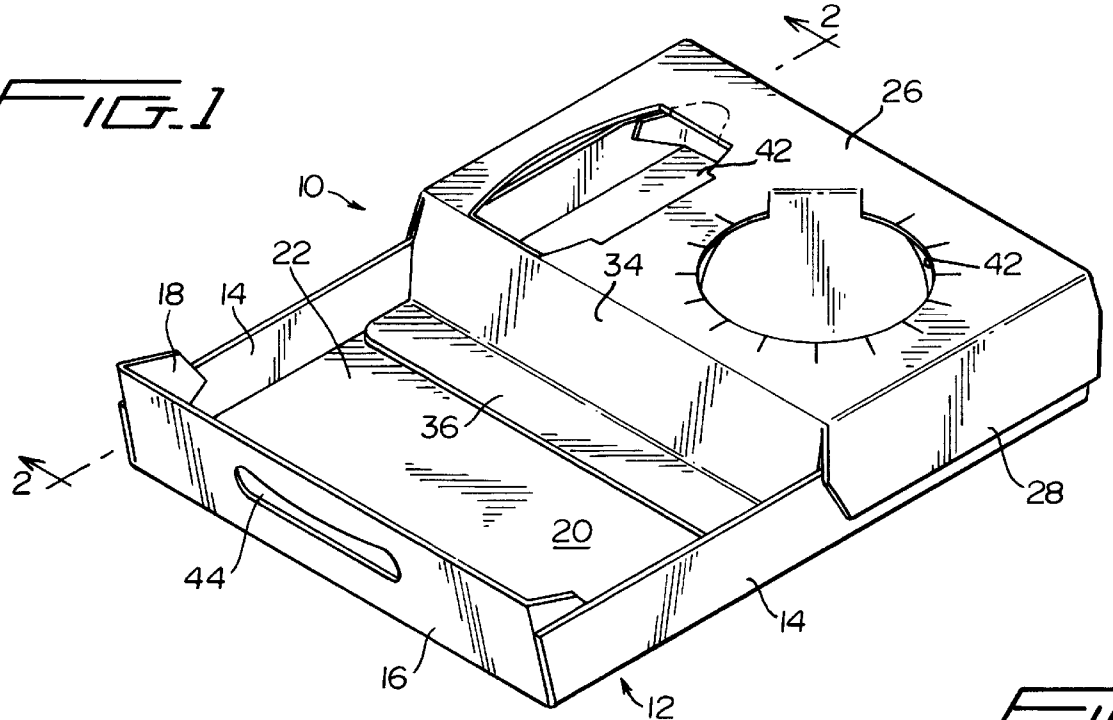
FIG. 1 is a perspective view of one form of carrier in its fully assembled usable configuration.
Figure 2:
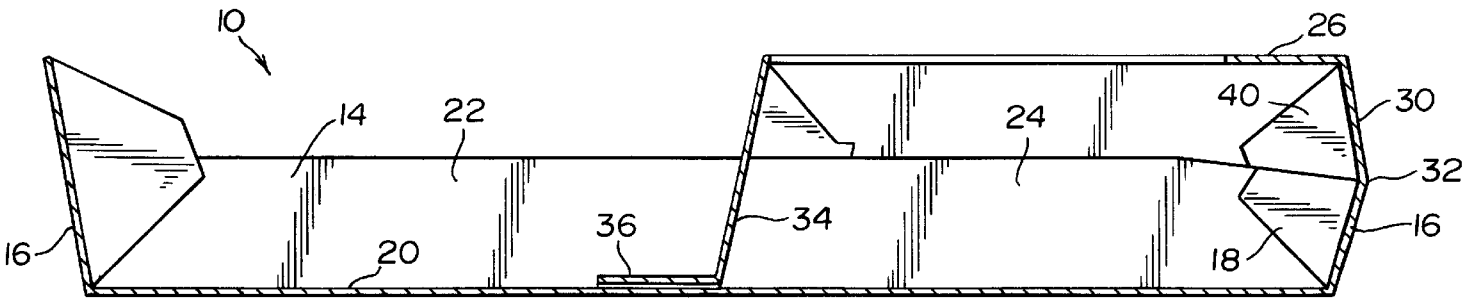
FIG. 2 is an enlarged longitudinal cross-sectional view taken substantially on a plane passing along line 2—2 in FIG. 1.
Figure 3:
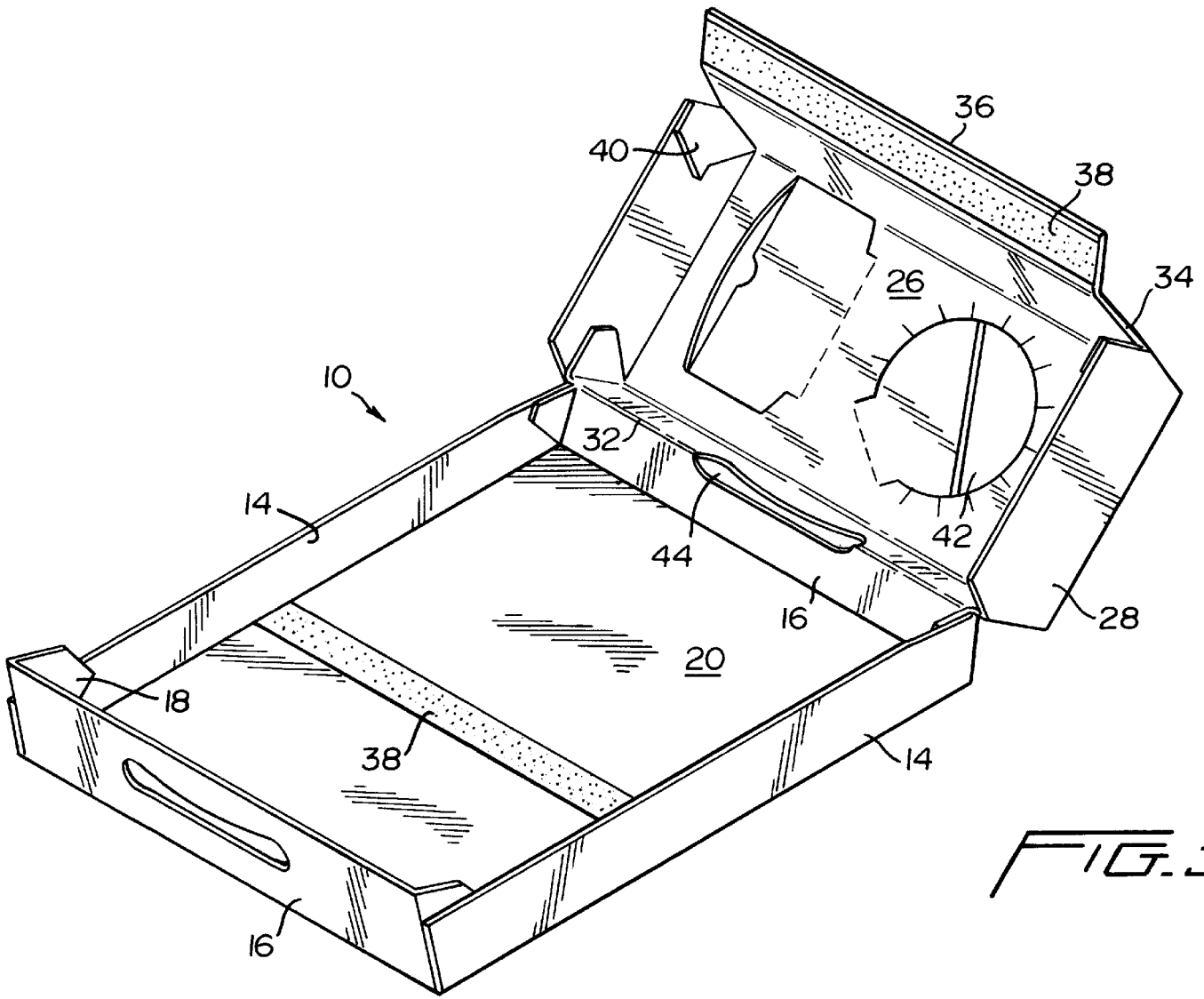
FIG. 3 is a perspective view of the carrier prior to final folding into its usable configuration and illustrating the stackable nature of the carton prior to full assembly.
Figure 6:
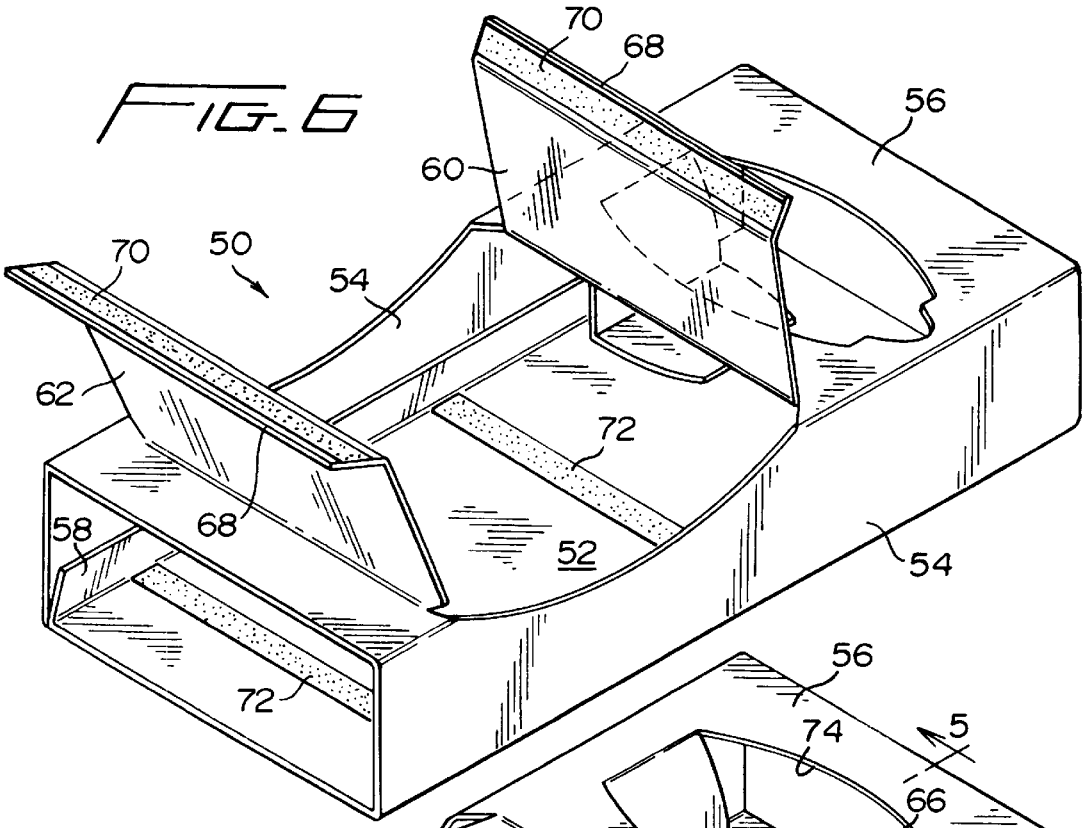
FIG. 6 illustrates the carrier prior to a final positioning of the partition walls with the walls upwardly turned to more clearly illustrate the positioning of the cohesive coatings or strips.
Figure 4:
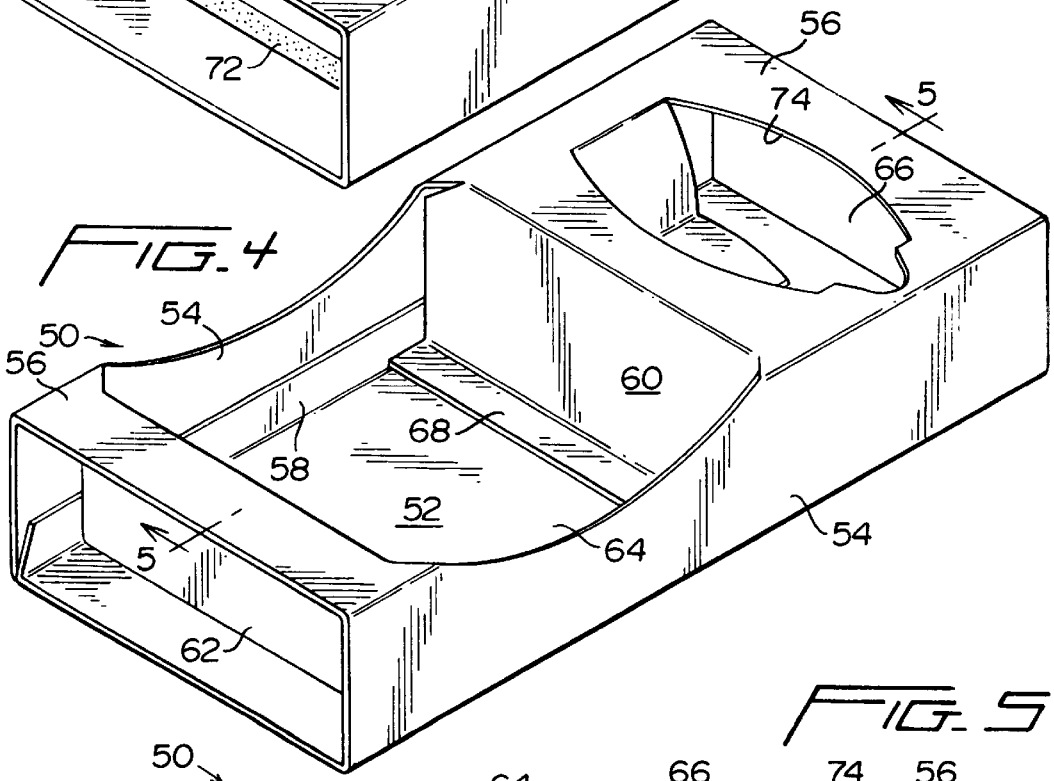
FIG. 4 is a perspective view of another form of carrier in its fully assembled usable configuration.
Figure 5:
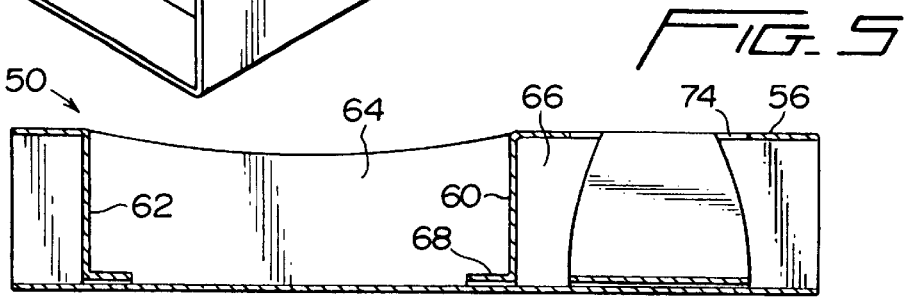
FIG. 5 is a longitudinal cross sectional view taken substantially on a plane passing along line 5—5 in FIG. 4.

Referring now more specifically to the drawings, FIGS. 1–3 illustrate one form of take-out carrier 10. The carrier 10, when fully assembled in its usable configuration as in FIGS. 1 and 2, includes an elongate preferably rectangular tray 12 with opposed side walls 14 and opposed end walls 16 end joined to the side walls 14 by conventional glue flaps 18. The walls 14 and 16 extend upwardly from the bottom panel 20 and are slightly outwardly inclined to facilitate stacking as shall be explained presently.

The tray is divided into a first upwardly opening compartment 22 and a second compartment 24 with an overlying elevated top panel 26. The top panel 26 is at a greater height than the upper edges of the tray side walls 14 and includes integral depending side walls 28 which are slightly outwardly inclined and overlap the side walls 14 of the tray. The top panel 26 also includes a depending rear wall 30 which is integrally joined to the upper edge of the corresponding tray end wall 16 along a fold line 32. A partition wall 34 is integral with the top panel 26 along the length thereof and depends from the forward or inner edge of the top panel 26 across the width of the tray 12 between the tray side walls 14. The lower edge portion of the partition panel 34 defines a full length edge flange 36 which is outwardly folded to overlie the tray bottom or bottom panel 20. The undersurface of the flange 36, as well as the upper surface of the bottom panel directly aligned with the flange 36 are both provided with cohesive coatings or strips for a direct bonding of the flange to the tray bottom only upon alignment of the strips. Such coatings do not adhere to any surface of the carrier other than a similar coating. It is preferred that the partition wall and the flange extend completely across the tray and into close sliding engagement with the opposed tray walls 14 whereby a positive seal is provided between the compartments 22 and 24 both transversely across the bottom 20 and vertically along the tray walls 14. It will also be appreciated that inasmuch as the conventional tab and slot interlocks have been eliminated, the tray walls, particularly adjacent the bottom panel 20, are imperforate to avoid any potential leakage both outward from the tray and between the compartments. As will noted in FIGS. 2 and 3 in particular, the walls extending from the second compartment top panel 26 are end joined in a conventional manner by appropriate glue flaps 40, forming in effect an inverted tray. The top panel itself will have appropriate container-receiving openings 42 therein for receiving, as desired, drink cups, french fry containers, and the like which will rest on the bottom of the tray 20 and be stabilized by the apertured top panel 26 in a conventional manner. Further, for ease in carrying the carrier 10, appropriate hand holes 44 can be provided in the opposed tray end walls 16 at an appropriate height above the bottom 20.

With reference to FIG. 3, the carrier 10, prior to actual use will only be partially assembled, that is the top panel unit, including the top panel and the walls thereof, will be outwardly folded in alignment with the tray as suggested by the partially folded illustration in FIG. 3. So positioned, the carriers, through the outward inclination of the tray and top panel walls, will compactly stack, one within another, for both shipping and storage purposes. This is an essential requirement for a conservation of space, and is of a significant economic advantage.

When the carrier is to be used either by the food server or the customer, the top panel 26 with the side and partition walls thereof is swung upwardly, inwardly and downwardly over the tray 12 which will automatically align the flange and the cohesive coating thereon with the tray cohesive coating and produce an immediate and effective bonding of the partition wall in position. This bond, if considered appropriate, can be enhanced by a slight finger pressure along the flange 36.

The use of cohesive coatings is significant in that these coatings will only adhere to each other, and thus do not in any way interfere with the stacking of the carriers in their partially assembled configuration as suggested in FIG. 3.

Referring now to FIGS. 4–7, another form of take-out carrier 50 is illustrated therein. The carrier 50 is initially formed by folding a sheet of paperboard or the like into an elongate rectangular tubular configuration, forming a bottom or bottom panel 52, opposed side walls 54 and a top panel 56. An appropriate edge glue flap 58 secures the free edge of the bottom 52 to the free edge of the adjacent side wall 54 to retain the tubular configuration and basically define a tray with an overlying top panel.

The top panel 56 has a pair of partition walls 60 and 62 defined therefrom. The partition wall 60, in the fully assembled usable carrier illustrated in FIG. 4, divides the carrier 50 into a first upwardly opening compartment 64 and a second compartment overlaid by the top panel 56, similar to the first described embodiment. The second partition wall 62, in the fully assembled usable carton, forms an opposed end wall for the open compartment 64 with this second partition wall 62 also depending from a minor portion of the top panel 56 toward the second end of the carrier remote from the second covered compartment 66.

Each of the partition walls 60 and 62 includes a full length outer edge flange 68 with a cohesive coating 70 along the length thereof. Corresponding cohesive coating strips 72 are provided transversely across the bottom 52 of the tray of the carrier whereby upon a downward folding of the opposed partition walls 60 and 62, the cohesive coatings 70 on the partition flanges will, upon alignment with the cohesive coatings 72 on the bottom 52, automatically signal the proper alignment of the partition walls and effect an immediate bonding of the partition walls in place. Until such time as the cohesive strips are aligned and engaged with each other, there would be no bonding.

Figure 7:
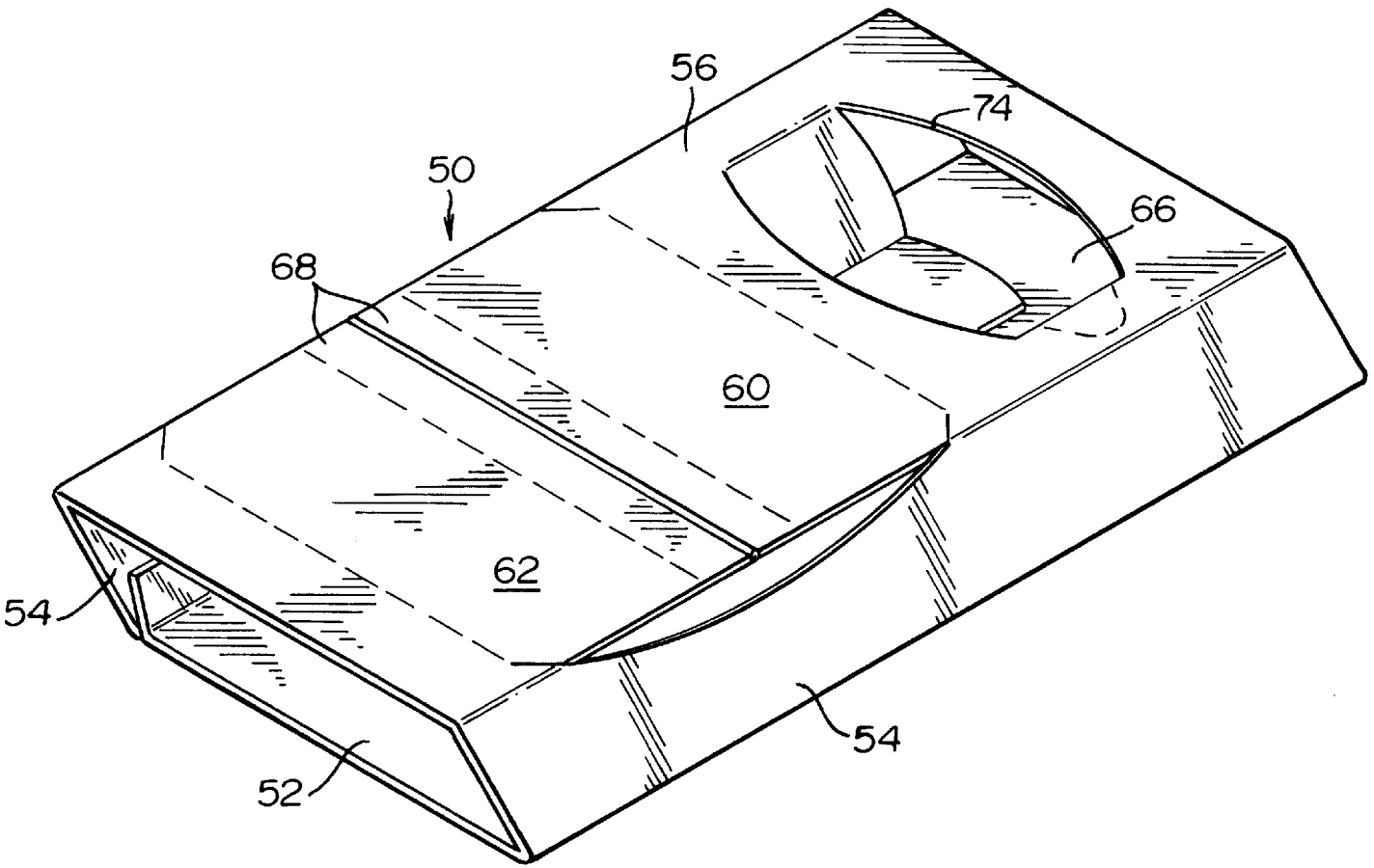
FIG. 7 is a perspective view of the carrier partially erected from its flat stackable configuration prior to assembly.
Figure 8:
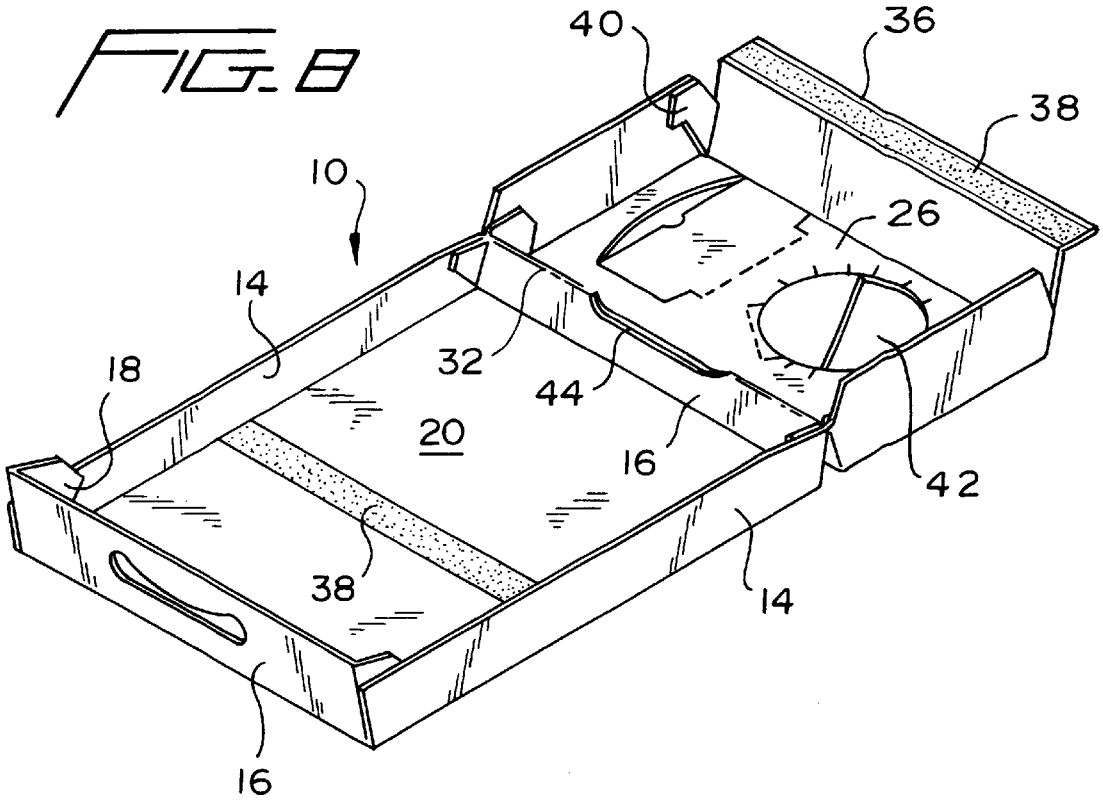
FIG. 8 is a perspective view of the carrier shown in FIG. 1 in a fully open position; and, FIG. 9 is a perspective view of the carrier of FIG. 4 shown in a collapsed position.
Figure 9:
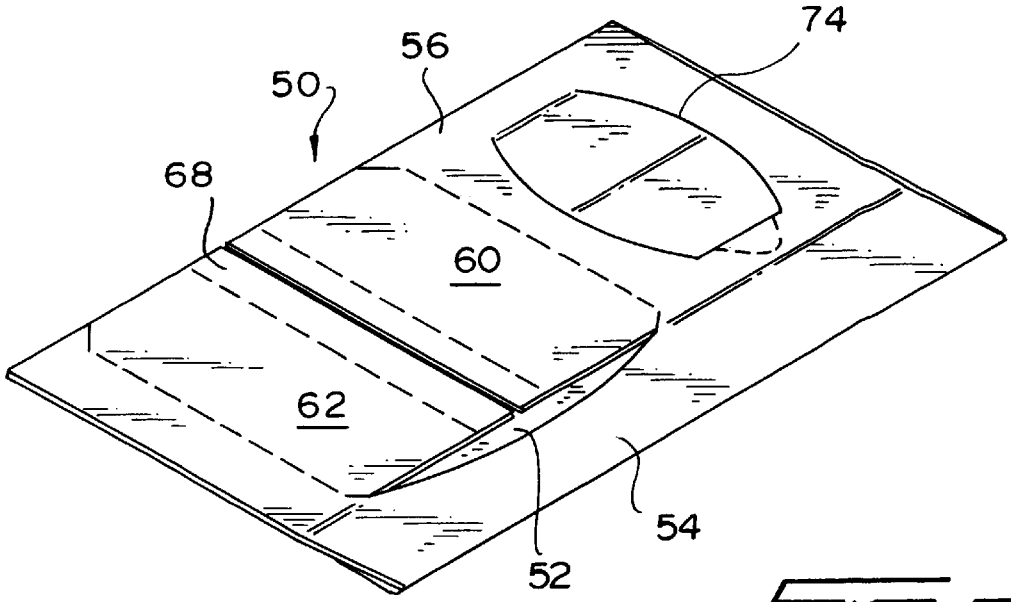

As suggested in FIG. 7, prior to assembly of the carrier 50 in its erected usable configuration, the partition panels 60 and 62 are coplanar with the top panel 56 with the cohesive strips on the flanges 68 adjacent to but slightly laterally spaced from each other, and similarly substantially laterally spaced from the cohesive strips 72 on the bottom 52. Thus, the carrier, in this partially assembled configuration, can be laterally collapsed to a substantially flat position for both shipping and storage purposes.

To complete the erection of the carrier at the point of use, one need merely press the opposed sides of the flattened carton to bring the opposed side walls substantially vertically, at which time the opposed partition walls are merely downwardly folded with the partition wall flanges 68 either slightly upwardly pre-folded or merely automatically folding upon engagement with the bottom 52 and bonding upon contact with the corresponding bottom cohesive coating strips 72. Once erected, the carrier cannot accidentally collapse. The assembled construction is both stable and of substantial strength in light of the full transverse securing of the lower edges of the partition walls and the extension of the partition walls across the full width of the tray.

As will be appreciated, the second compartment 66 of the carrier will have the overlying portion of the top panel 56 provided with an appropriate opening or openings 74 for the accommodation of containers such as a french fry carton. The outer end of this compartment 66 can remain open in that the foodstuffs received therein will be in their own containers. The partition wall 62 will close the outer end of the first compartment 64 slightly inwardly spaced from the extreme end of the carrier to provide a small hand grip area.

While only two embodiments have been illustrated, it is to be appreciated that the concepts of the invention are equally applicable to other forms of carriers which require assembly or final assembly at the point of use. Such other carriers can include end walls which automatically assemble upon an erection of the carrier, carriers with covered and apertured compartments at the opposed ends thereof with a central open tray area, and the like.

It is contemplated that use of cohesive strips, as opposed to the conventional locking tabs will, in addition to simplifying final assembly at the point of use, simplify manufacturing, both in the die cutting of the blanks and the folding thereof. Further, is contemplated that the cohesive strips can actually be applied at the time of the printing of the decorative and informative indicia on the carton blanks as a part of the printing process. Basically, the significantly advanced product of the invention can be produced with only very minor modifications in the manufacture procedures, thus substantially enhancing the practicability and economic feasibility of the carrier of the invention.

The invention is not to be taken as limited to the illustrated embodiments or to all the details thereof, as modification and variations thereof may be made without the parting from the spirit or scope of the invention.

What is claimed is:

1. A take-out carrier for foodstuffs formed from a blank of sheet material, said carrier being foldable from a first partially assembled stackable configuration to a second erected and fully assembled usable configuration;

said carrier in said usable configuration comprising a tray portion with a bottom panel and a pair of laterally spaced substantially parallel side walls extending upward from said bottom panel, a top panel extending between said side walls in spaced relation above said bottom panel and overlying a portion of said bottom panel, said top panel extending inward from an end of said tray portion to an inner edge, a partition wall integral with said top panel along said inner edge and depending therefrom to said bottom panel, said partition panel including a partition flange foldable therefrom into parallel overlying relation to said bottom panel, said bottom panel having an upper surface, said flange having a lower surface with a cohesive material thereon, said upper surface of said bottom panel, in a strip underlying said partition wall flange, having a cohesive material thereon bonding solely to the cohesive material on said partition wall flange, said carrier in said partially assembled configuration having said partition flange substantially parallel to, laterally remote from, and out of contact with said cohesive material on the upper surface of said bottom panel.

2. The carrier of claim 1 wherein said partition wall and said flange extend across the full width of said tray portion between said side walls.

3. The carrier of claim 2 wherein said cohesive material on said flange extends along the full length of said flange, said cohesive strip on said bottom panel extending across the full width of said bottom panel between said side walls.

4. The carrier of claim 3 wherein said top panel has at least one opening defined therethrough for receiving and supporting a foodstuff container.

5. The carrier of claim 4 wherein said tray portion includes opposed spaced end walls extending between and secured to said side walls, said top panel having an outer edge with an outer wall therealong integral with a corresponding end wall on said tray portion along a fold line for pivotal movement of said top panel and said partition wall between said stackable configuration with said top panel and said partition wall remote from said tray portion to said usable configuration with said top panel extending between said tray side walls and with said partition wall flange engaged with said tray portion bottom panel.

6. The carrier of claim 4 wherein, in said stackable configuration, said partition wall extends substantially coplanar with said top panel, said tray side walls being laterally folded with one side wall overlying said bottom panel and the other side wall extending generally laterally beyond said bottom panel, and with said top panel and said partition wall overlying said bottom panel.

7. A method of forming a take-out carrier from a partially collapsed stackable configuration to an erected usable configuration wherein said carrier includes a tray portion with a bottom and a pair of opposed side walls extending from said bottom, a top panel foldably joined to said tray portion, a partition wall foldably joined to said top panel, a cohesive coating on said partition wall and a cohesive coating on said bottom, said coatings being remote from each other in said stackable configuration;

the steps of erecting the carrier comprising;

positioning said top panel in overlying spaced relation above said bottom, extending said partition wall from said top panel to said bottom with said partition wall coating aligned over said bottom coating, and engaging said partition wall coating with said bottom coating to fix said partition wall to said bottom and between said bottom and said top panel.

8. A take-out carrier for foodstuff formed from a unitary blank of foldable sheet material, said carrier being erectable from a first partially-assembled stackable configuration to a second usable configuration;

said carrier in said usable configuration comprising a tray portion with a bottom and opposed laterally spaced side walls extending upward from said bottom;

a partition wall foldable from said blank, said partition a wall having an inner edge portion with a cohesive coating thereon, said bottom, transversely thereacross between said side walls, having a cohesive coating thereon, complementing the partition wall coating for receiving and fixing said partition wall to said bottom upon alignment and engagement of said cohesive coatings, said partition wall, in said stackable configuration of said carrier, being positioned with said cohesive coating thereon remote from said cohesive coating on said tray portion bottom, wherein engagement between said coatings is precluded until said coatings are aligned in said usable configuration.

9. The carrier of claim 8 including a top panel foldable from said blank and overlying said tray portion in said usable configuration, said partition wall being integral with and folded from said top panel to depend therefrom into engagement with said bottom.

10. The carrier of claim 9 wherein said partition wall, in said stackable configuration, extends coplanar with said top panel with said cohesive coating on said partition wall laterally remote from said cohesive coating on said bottom.

11. The carrier of claim 9 wherein said top panel in said stackable configuration, extends substantially coplanar beyond said tray portion bottom with said partition wall outwardly spaced from said tray portion.

* * * * *